US006056163A

United States Patent [19]

Lai

[11] Patent Number: 6,056,163

[45] Date of Patent: May 2, 2000

[54] LIQUID DISPENSER

[76] Inventor: Jenn-Shyang Lai, 3 F, No. 21, Lane 106, Ta-Jung St., Ta-Ya Hsiang, Taichung Hsien, Taiwan

[21] Appl. No.: 09/362,000

[22] Filed: Jul. 28, 1999

[51] Int. Cl.[7] ..... B65D 88/54

[52] U.S. Cl. ..... 222/321.2; 222/321.9

[58] Field of Search ..... 222/1, 321.1, 321.2, 222/321.7, 321.9, 394

[56] References Cited

U.S. PATENT DOCUMENTS

| | | | |
|---|---|---|---|
| 2,961,131 | 11/1960 | Bradbury | 222/321.2 |
| 3,160,182 | 12/1964 | O'Donnell | 222/321.2 |
| 3,180,374 | 4/1965 | Muller | 222/394 |
| 3,289,949 | 12/1966 | Roth | 222/394 |
| 4,271,875 | 6/1981 | Milcos | 222/394 |

*Primary Examiner*—Joseph A. Kaufman
*Assistant Examiner*—Thach Bui
*Attorney, Agent, or Firm*—Baker & Botts L.L.P.

[57] ABSTRACT

A liquid dispenser includes a hollow shank having top and bottom openings and a fluid chamber. A closure member is sealingly mounted on the top opening. A hollow piston rod has closed and open ends, an inner fluid passage, and an aperture in communication with the fluid passage. A hollow piston is sleeved movably around the piston rod and has a contact part in contact with the piston rod to seal releasably the aperture, and a skirt part. A spring seat has a top rim extending between the skirt part and the closed end to abut against the contact part to seal releasably the aperture, a top blind hole having a cross-section greater than that of the closed end of the piston rod, and a bottom portion. An upper urging unit urges downward the piston. A ball is seated at the bottom opening. A lower urging unit urges the spring seat and the ball against the closed end and the bottom opening, respectively.

5 Claims, 15 Drawing Sheets

LIQUID DISPENSER

BACKGROUND OF THE INVENTION

1. Field of the Invention

This invention relates to a liquid dispenser, more particularly to a liquid dispenser adapted to be connected to a container for dispensing a liquid from the container.

2. Description of the Related Art

FIGS. 1 and 2 illustrate a conventional liquid dispenser 10. The liquid dispenser 10 is to be connected to a container (not shown) for dispensing a liquid from the container. The liquid dispenser 10 includes a hollow shank 11 having a fluid chamber 111. A hollow piston rod 12 extends inside the shank 11, and has a fluid passage 121 extending therein and a stopper 122 to confine the movement of the piston rod 12 in the shank 11. An upper spring 13 seated on the stopper 122 is sleeved around the piston rod 12 to urge downward a hollow piston 14 which is also sleeved around the piston rod 12 below the upper spring 13. The piston 14 has a contacting part 141 in sliding contact with an outer surface of the piston rod 12. A spring seat 15 includes a radially extending flange portion 153 and an upper hollow tubular portion 151 extending upward from the flange portion 153 into a bottom hole 123 in the piston rod 12. The bottom hole 123 receives the tubular portion 151 in a way that it is in intimate contact with the tubular portion 151. The tubular portion 151 is provided with a fluid aperture 152 adjacent to the flange portion 153 for communication with the fluid passage 131. The flange portion 153 abuts against a skirt portion 142 of the piston 14 to seal releasably the aperture 152. Referring now to FIG. 3, as the piston rod 12 is pressed downward, the piston 14 is pushed upward by the fluid inside the fluid chamber 111 to move away from the skirt portion 142 and to place the aperture 152 in communication with the fluid chamber 111 so that the fluid inside the fluid chamber 111 can be dispensed out of the liquid dispenser 10. It is noted that, since the tubular portion 151 of the spring seat 15 is required to be in tight contact with the bottom hole 123 in the piston rod 12, and since the spring seat 15 and the piston rod 12 are both made from a rigid plastic material, the insertion of the former into the latter during assembly can become difficult, and breakage of both parts may occur. Moreover, it is not easy to completely eliminate the air in the bottom hole 123 upon insertion of the piston rod 12, thereby resulting in an incorrect positioning of the latter.

FIGS. 4 and 5 illustrate another conventional liquid dispenser 20. The liquid dispenser 20 includes a hollow shank 21 having a fluid chamber 211. A hollow piston rod 22 extends into the shank 21, and has a fluid passage 221 extending therein, a stopper 223 to confine the movement of the piston rod 22, and a fluid aperture 222 near a bottom portion of the piston rod 22 for communication with the fluid passage 221. An upper spring 23 seated on the stopper 223 is sleeved around the piston rod 22 to urge downward a hollow piston 24 which is also sleeved movably around the piston rod 22 below the upper spring 23. The piston 24 includes a contacting portion 241 in sliding contact with the piston rod 22 to enclose sealingly the aperture 222. A spring seat 25 is sleeved around the bottom portion of the piston rod 22, and is seated and urged by a lower spring 26. The spring seat 25 has an axially extending through-hole 251 confined by an inner surface 252 which encloses tightly the bottom portion of the piston rod 22 so that the spring seat 25 may move along the piston rod 22. Referring now to FIG. 6, as the piston rod 22 is pressed downward, the piston 24 is pushed upward via the fluid inside the chamber 211 to move away from the spring seat 25 and to place the aperture 222 in communication with the fluid chamber 211, thereby dispensing the fluid out of the liquid dispenser 20. However, the spring seat 25 is bound to the bottom portion of the piston rod 22 only via the intimate contact of the inner surface 252 with the bottom portion of the piston rod 22, such contact may become loosened and the spring seat 25 may be moved away from its binding place due to an unbalanced force acting on the spring seat 25 by virtue of the lower spring 26 and the upper spring 23. Since the piston 24 abuts against the spring seat 23, it may be misplaced, as a result of the above described unbalanced force, to a position that can cause leakage of the fluid or hinder movement of the piston 24 to move to the position that places the aperture 222 in communication with the fluid chamber 211 upon pressing of the piston rod 22.

FIGS. 7 and 8 further illustrate another conventional liquid dispenser 30. The liquid dispenser 30 includes a hollow shank 31 having a fluid chamber 311. A hollow piston rod 32 extends into the shank 31, and has a fluid passage 321 extending therein, a bottom hole 323, and a radially extending stopper 322 adjacent to the bottom hole 323. A spring seat 33 urged by a lower spring 35 includes a top hollow tubular portion 331 extending upwardly into the bottom hole 323, a downwardly extending bottom portion 334 extending downward into the lower spring 35, and a radially extending flange 333 seated by the lower spring 35 and extending upward from the bottom portion 334. A fluid aperture 332 is provided in the bottom of the tubular portion 331 to communicate with the fluid passage 321. A hollow tapered piston 34 is disposed between the piston rod 32 and the spring seat 33, and includes a top end portion 341 abutting sealingly against the stopper 322 and a skirt portion 343 extending downward from the top end portion 341 and receiving the flange 333 therein. A radially extending shoulder 342 extends from the skirt portion 343 to seat sealingly on the flange 333 and seal releasably the aperture 332. Referring now to FIG. 9, as the piston rod 32 is pressed downward, the shoulder 342 of the piston 34, which is made from a soft plastic material, is pushed upward by the fluid under it, thereby flexing the shoulder 342. Such flexing will move the shoulder 342 away from the flange 333 to place the aperture in communication with the fluid chamber 311. However, since the piston 34 is made from soft plastic material, it tends to degrade easily because of the expansion and contraction of the plastic material due to the affect of the weather, thereby arising in poor sealing at the shoulder 342.

SUMMARY OF THE INVENTION

Therefore, it is an object of the present invention to provide a liquid dispenser that is capable of overcoming the disadvantages described above.

Accordingly, a liquid dispenser of the present invention comprises: a hollow shank having top and bottom openings and a fluid chamber extending inside the hollow shank from the top opening to the bottom opening; a closure member sealingly mounted on the top opening; a hollow piston rod having closed and open ends, an inner fluid passage extending inside the piston rod from the closed end to the open end, and a fluid exit aperture disposed above the closed end and in communication with the fluid passage, the closed end being received inside the shank, the open end extending out of the shank and the closure member, the piston rod being movable upward and downward inside the shank; a hollow piston sleeved movably around the piston rod adjacent to the closed end and having a contact part in contact with the piston rod to seal releasably the aperture, and a skirt part extending downward from the contact part; a spring seat disposed inside the shank below the piston and having a top rim, a top blind hole confined by the top rim, and a downwardly extending bottom portion below the top blind hole, the top blind hole having a cross-section greater than that of the closed end so as to provide a clearance between the closed end and the top rim, the top rim extending between the skirt part and the closed end of the piston rod to abut sealingly against the contact part when the piston rod is moved upward; upper urging means disposed inside the shank and sleeved around the piston rod above the piston for urging downward the piston to enable the contact part to seal the aperture; a ball movably seated at the bottom opening for closing the bottom opening; and lower urging means disposed inside the shank and having an upper end mounted on the bottom portion of the spring seat and a lower end engaging the ball, the upper and lower ends urging the spring seat and the ball against the closed end and the bottom opening, respectively; wherein the contact part moves away from the aperture and the top rim to place the aperture in communication with the fluid chamber and the fluid passage when the piston rod is moved downward.

BRIEF DESCRIPTION OF THE DRAWINGS

In drawings which illustrate embodiments of the invention.

DETAILED DESCRIPTION OF THE PREFERRED EMBODIMENTS

Figure 1:
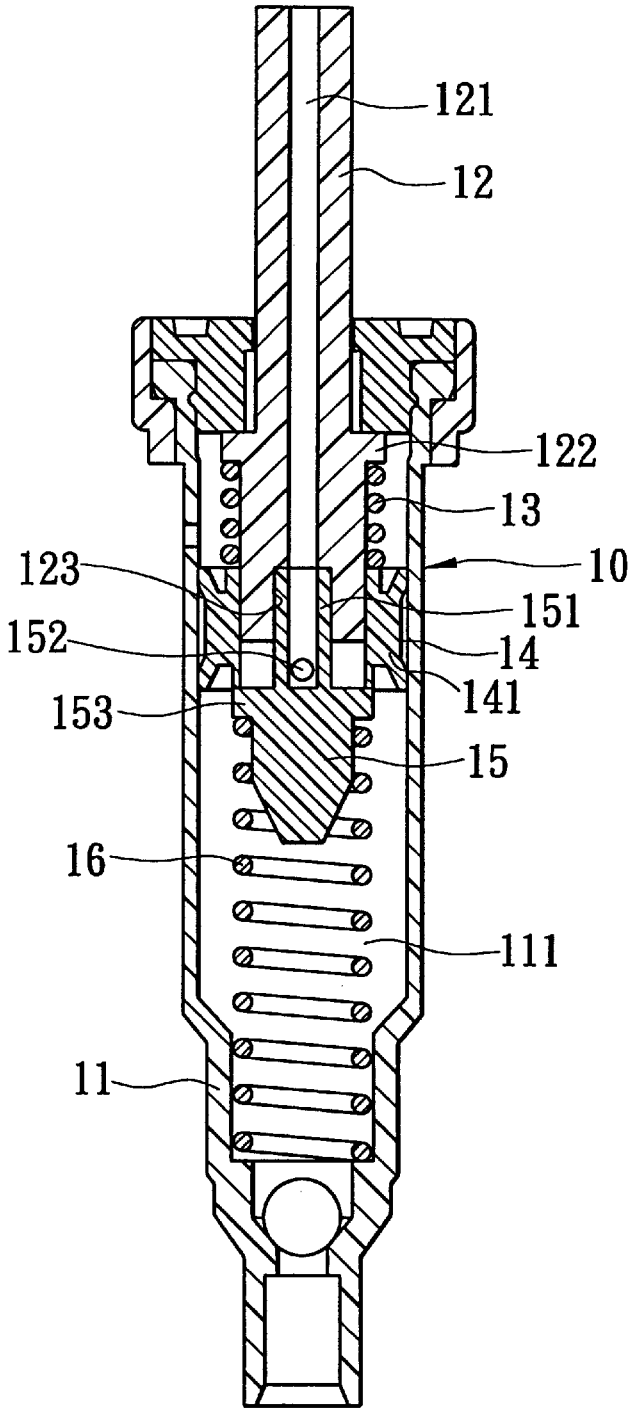
FIG. 1 PRIOR ART
FIG. 1 is a schematic cross-sectional side view of a conventional liquid dispenser.
Figure 2:
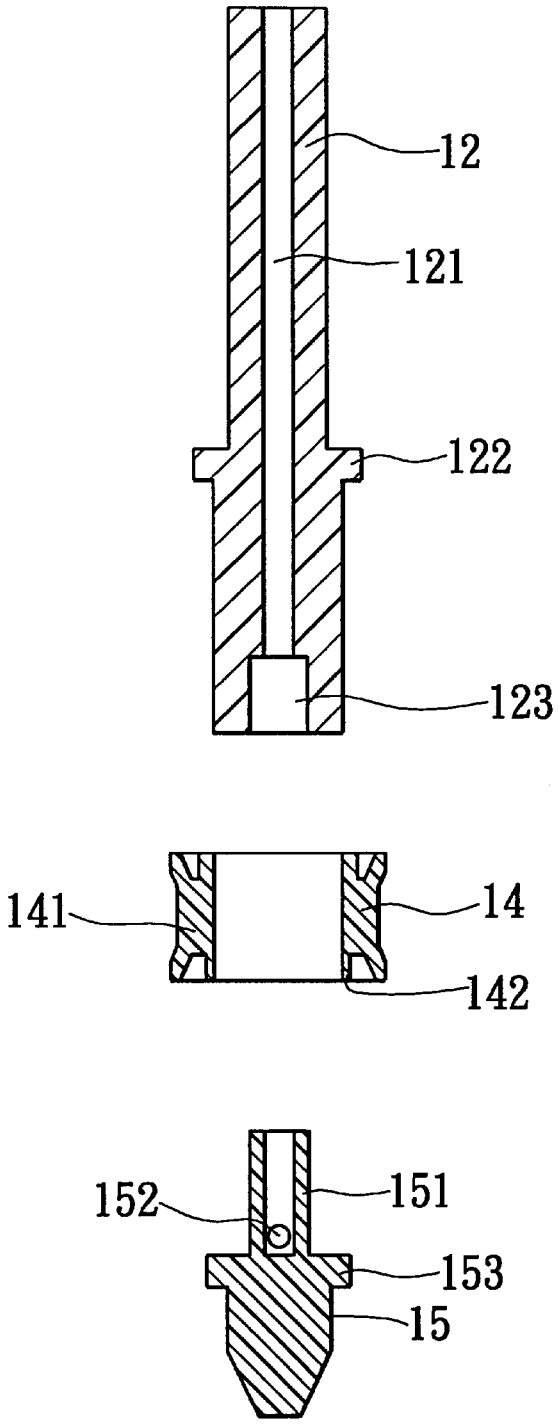
FIG. 2 PRIOR ART
FIG. 2 is a fragmentary exploded cross-sectional side view of the liquid dispenser of FIG. 1.
Figure 3:
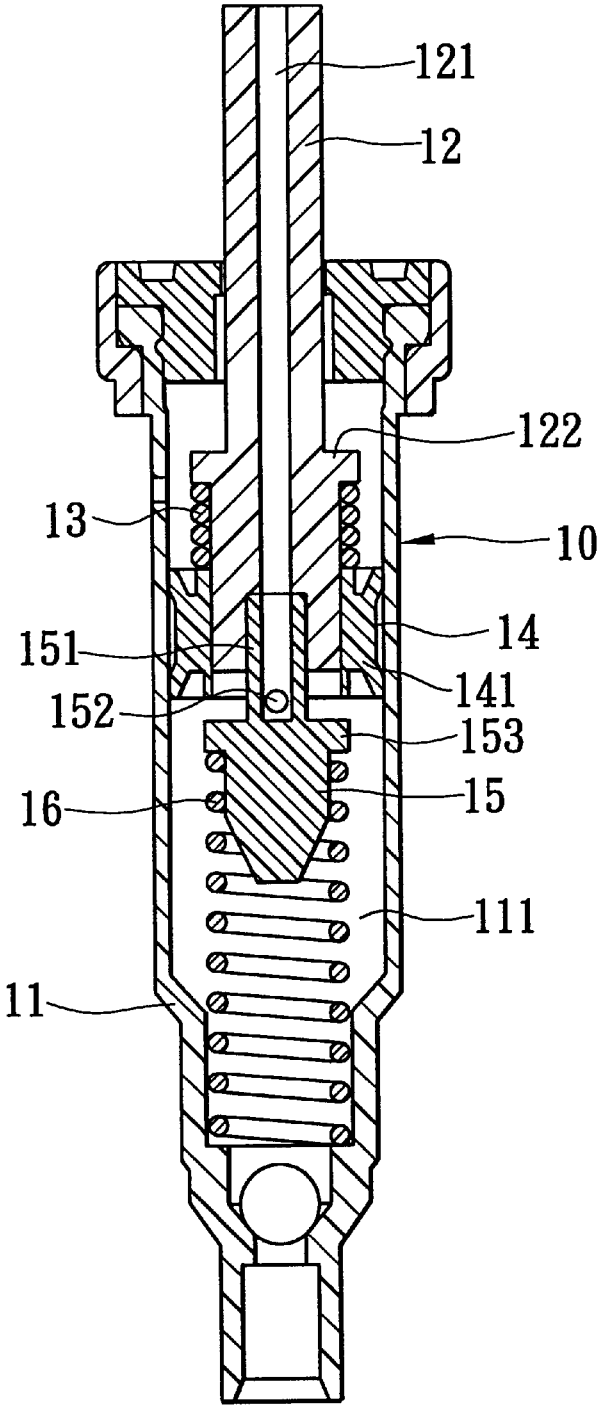
FIG. 3 PRIOR ART
FIG. 3 is a schematic cross-sectional side view of the liquid dispenser of FIG. 1 in an operated state.
Figure 4:
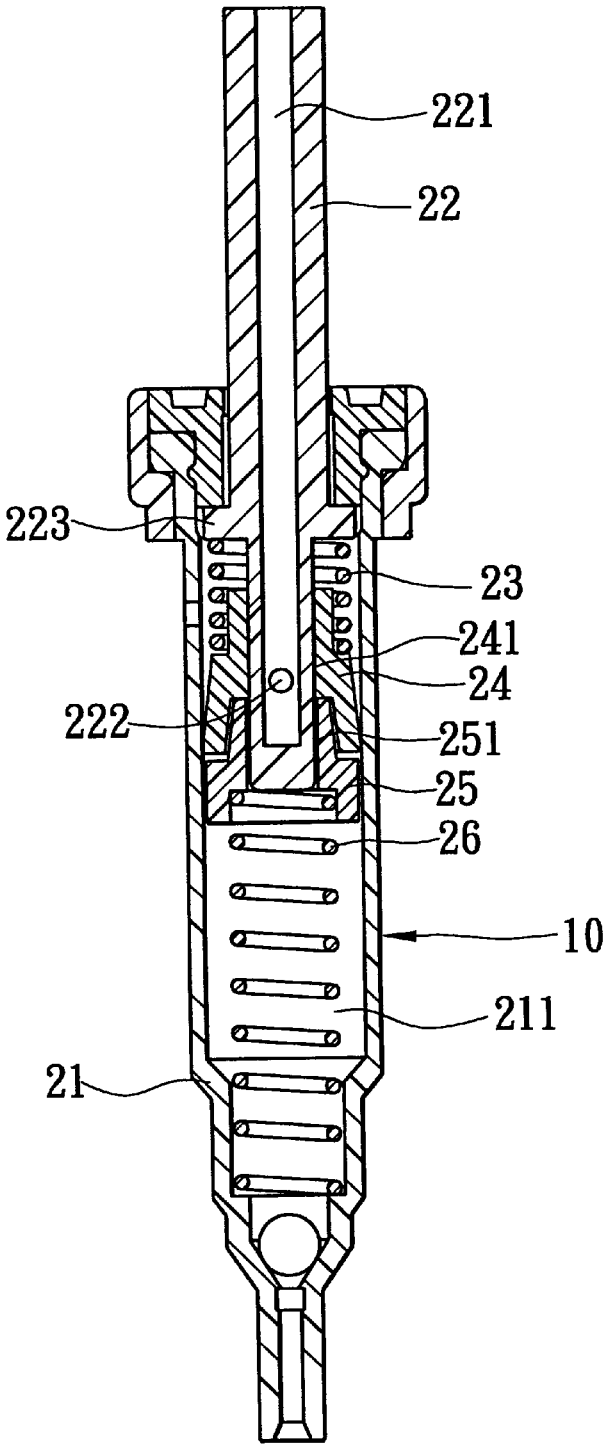
FIG. 4 PRIOR ART
FIG. 4 is a schematic cross-sectional side view of another conventional liquid dispenser.
Figure 5:
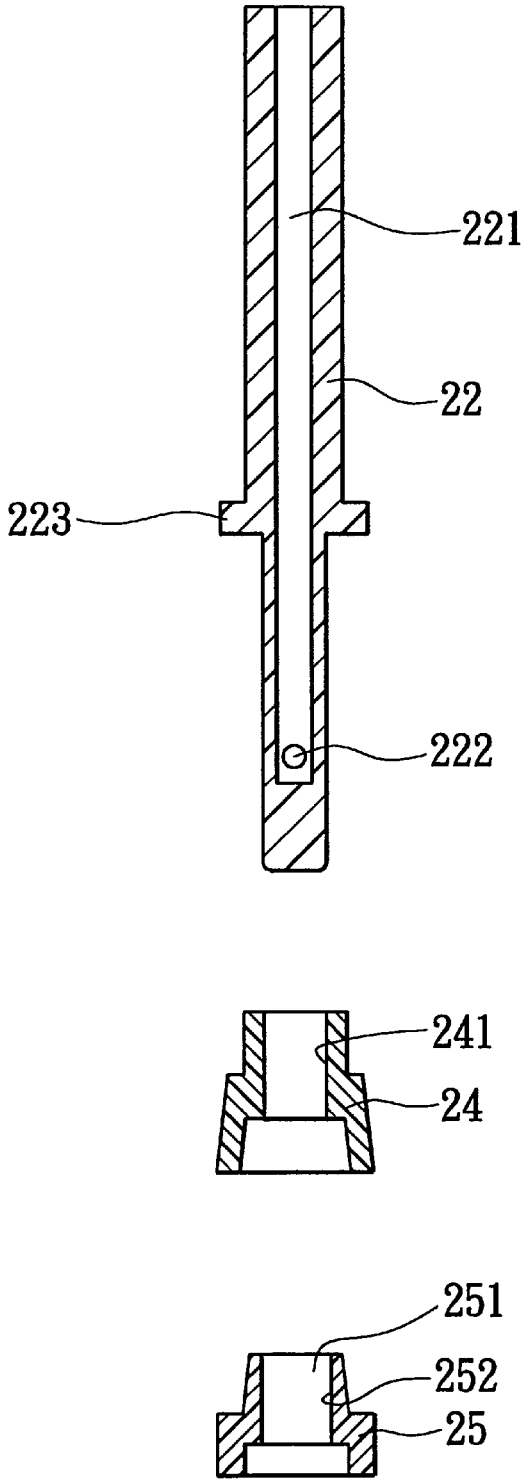
FIG. 5 PRIOR ART
FIG. 5 is a fragmentary exploded cross-sectional side view of the liquid dispenser of FIG. 4.
Figure 6:
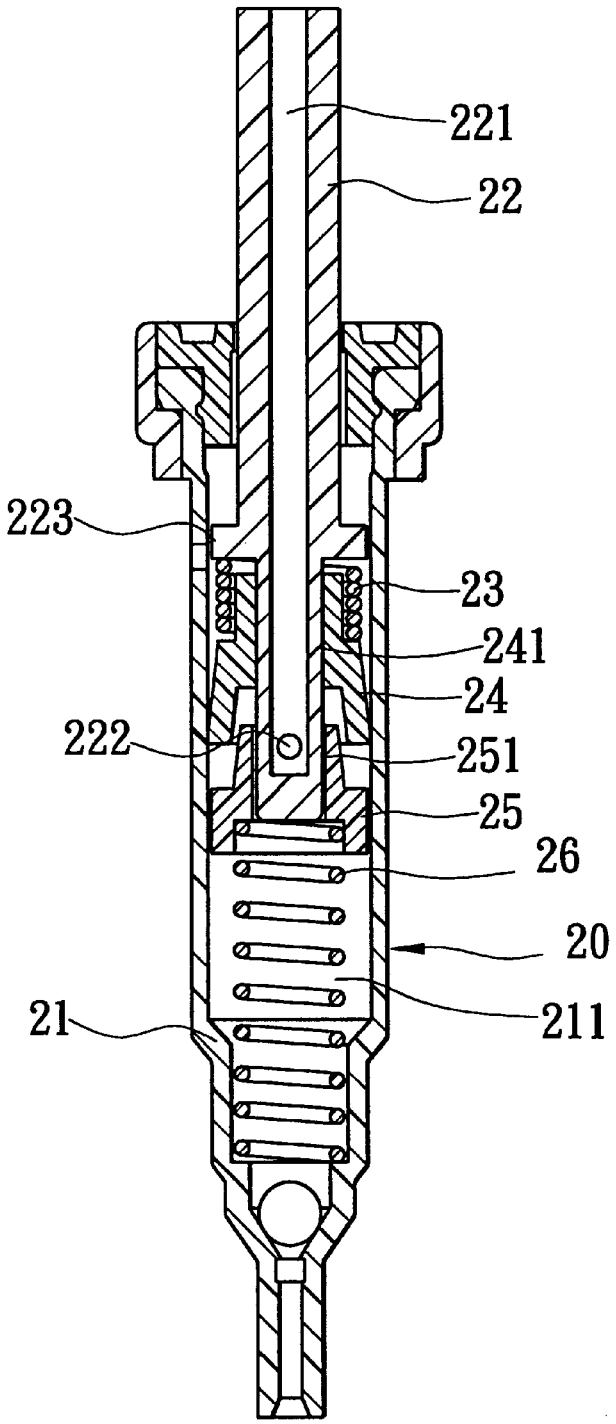
FIG. 6 PRIOR ART
FIG. 6 is a schematic cross-sectional side view of the liquid dispenser of FIG. 4 in an operated state.
Figure 7:
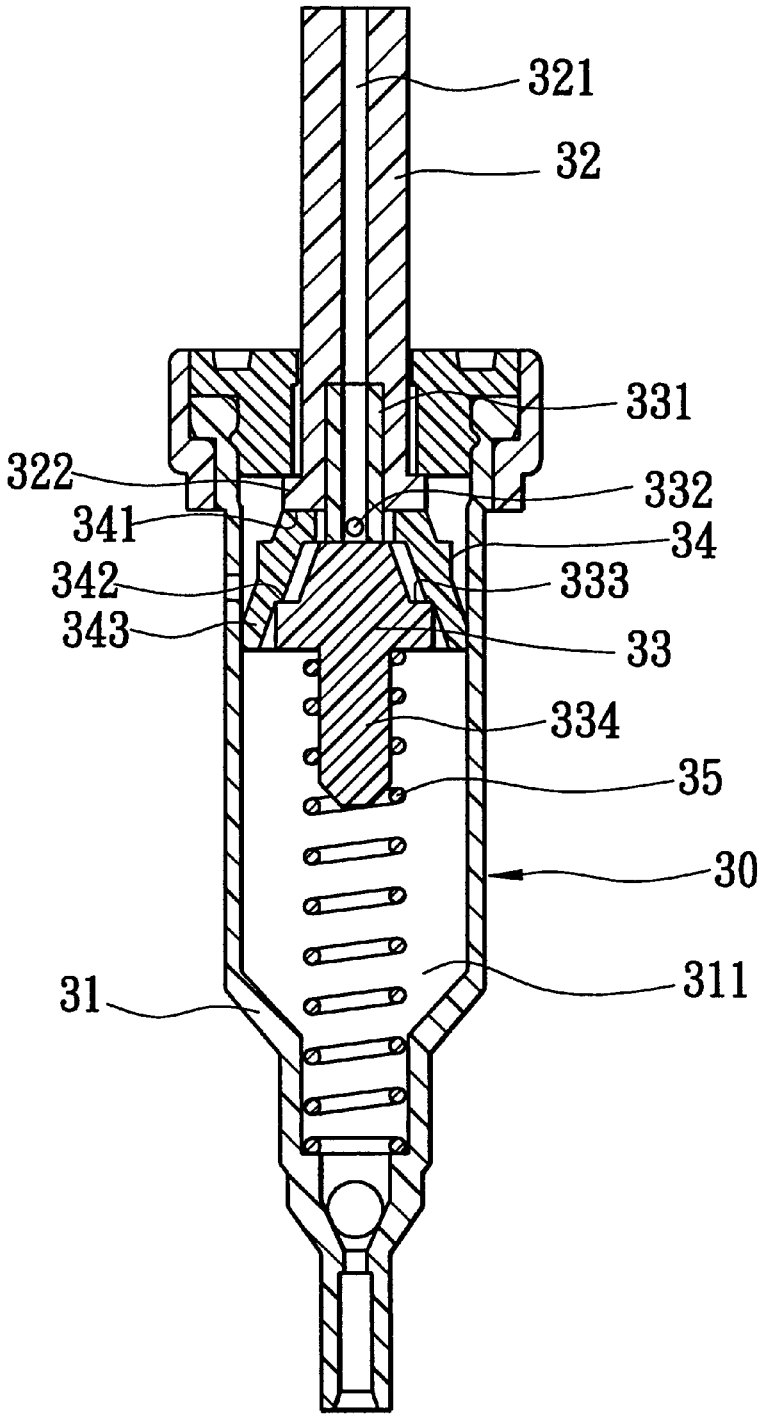
FIG. 7 PRIOR ART
FIG. 7 is a schematic cross-sectional side view of another conventional liquid dispenser.
Figure 8:
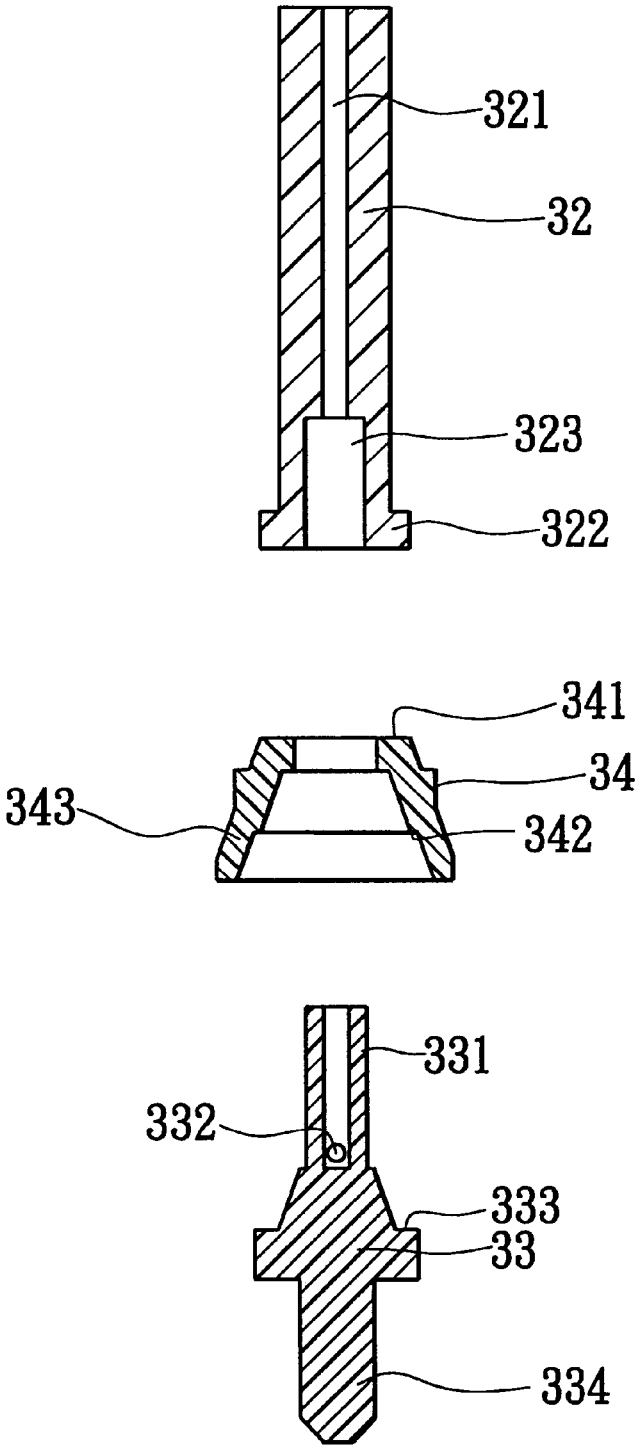
FIG. 8 PRIOR ART
FIG. 8 is a fragmentary exploded cross-sectional side view of the liquid dispenser of FIG. 7.
Figure 9:
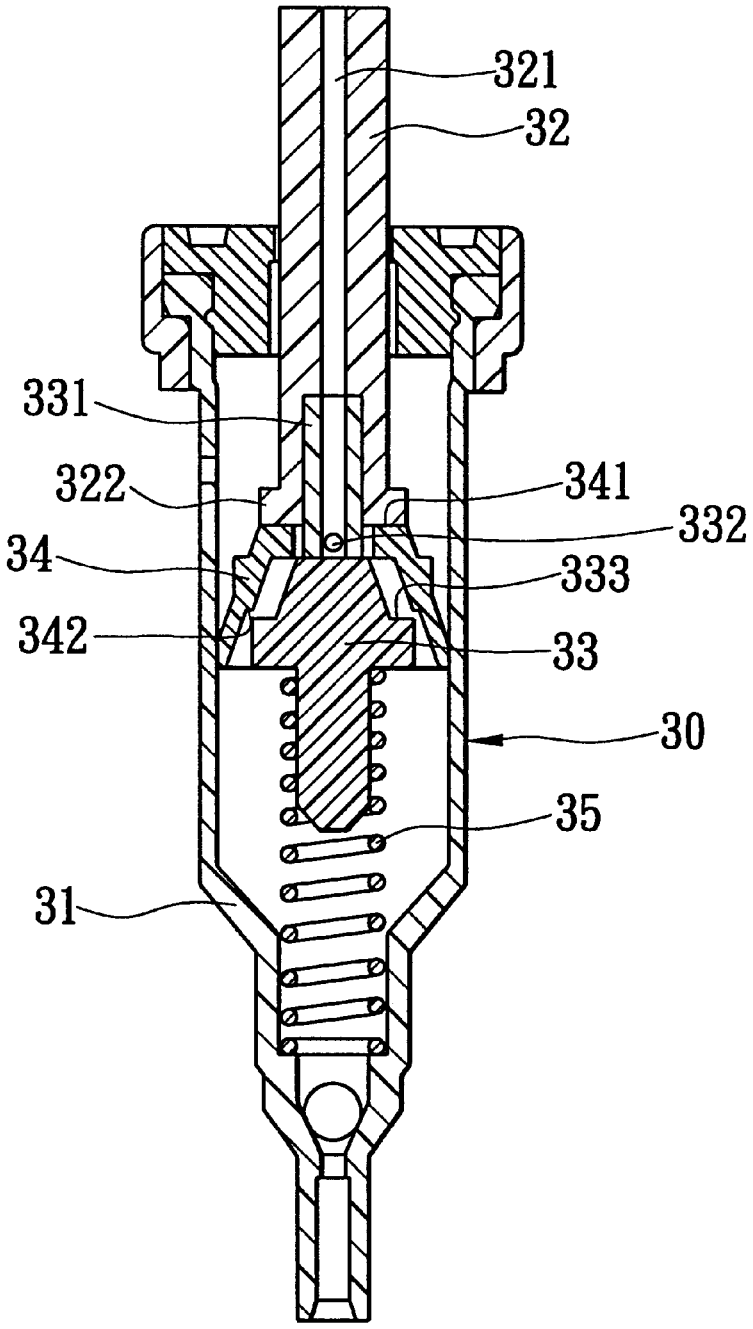
FIG. 9 PRIOR ART
FIG. 9 is a schematic cross-sectional side view of the liquid dispenser of FIG. 8 in an operated state.
Figure 10:
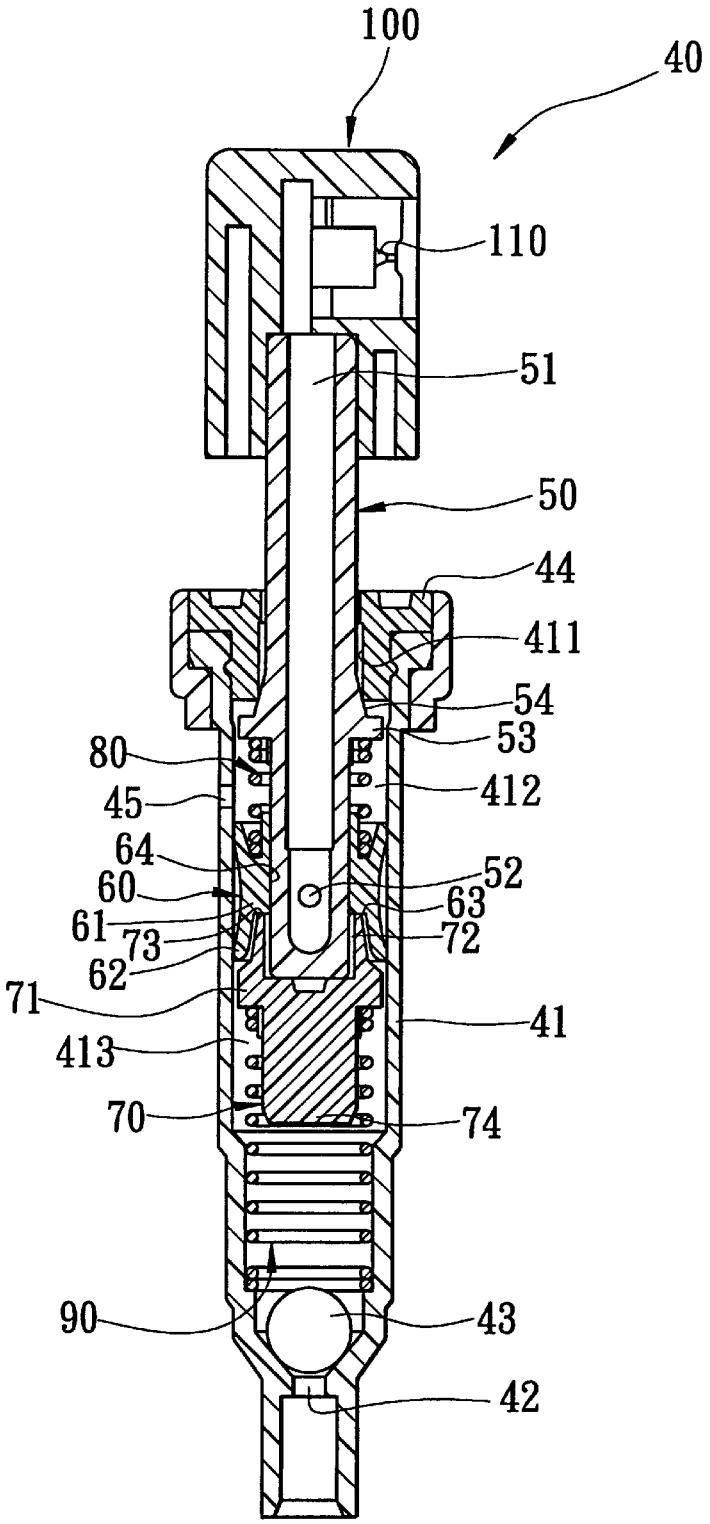
FIG. 10 is a schematic cross-sectional side view of a liquid dispenser embodying this invention.
Figure 11:
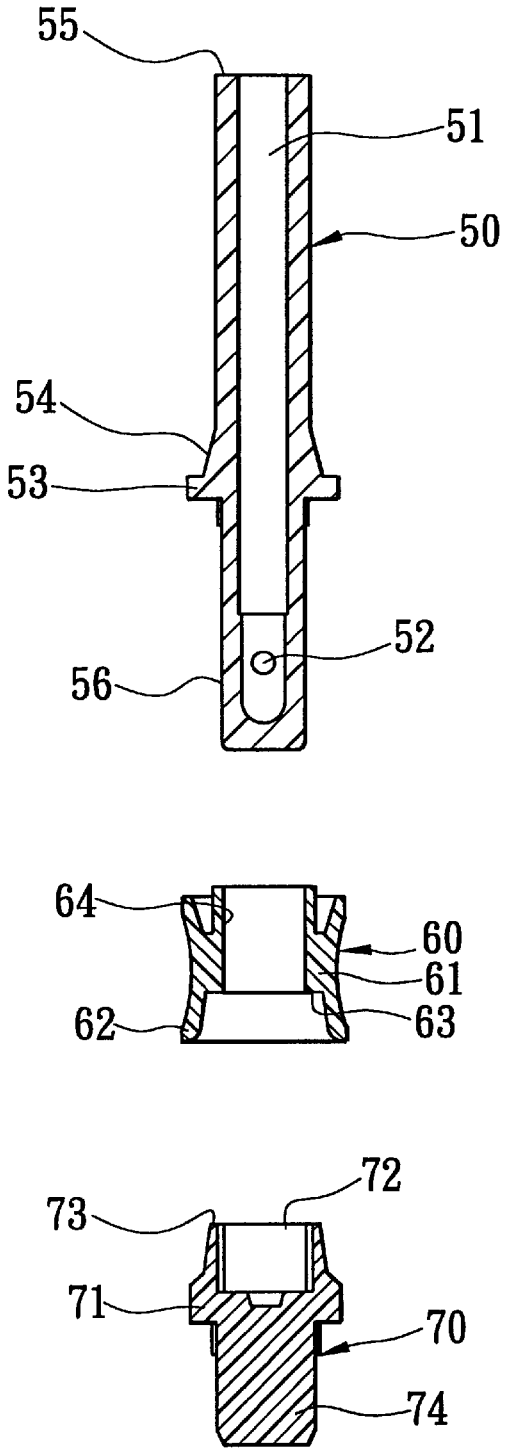
FIG. 11 is a fragmentary exploded cross-sectional side view of the liquid dispenser of FIG. 10.
Figure 12:
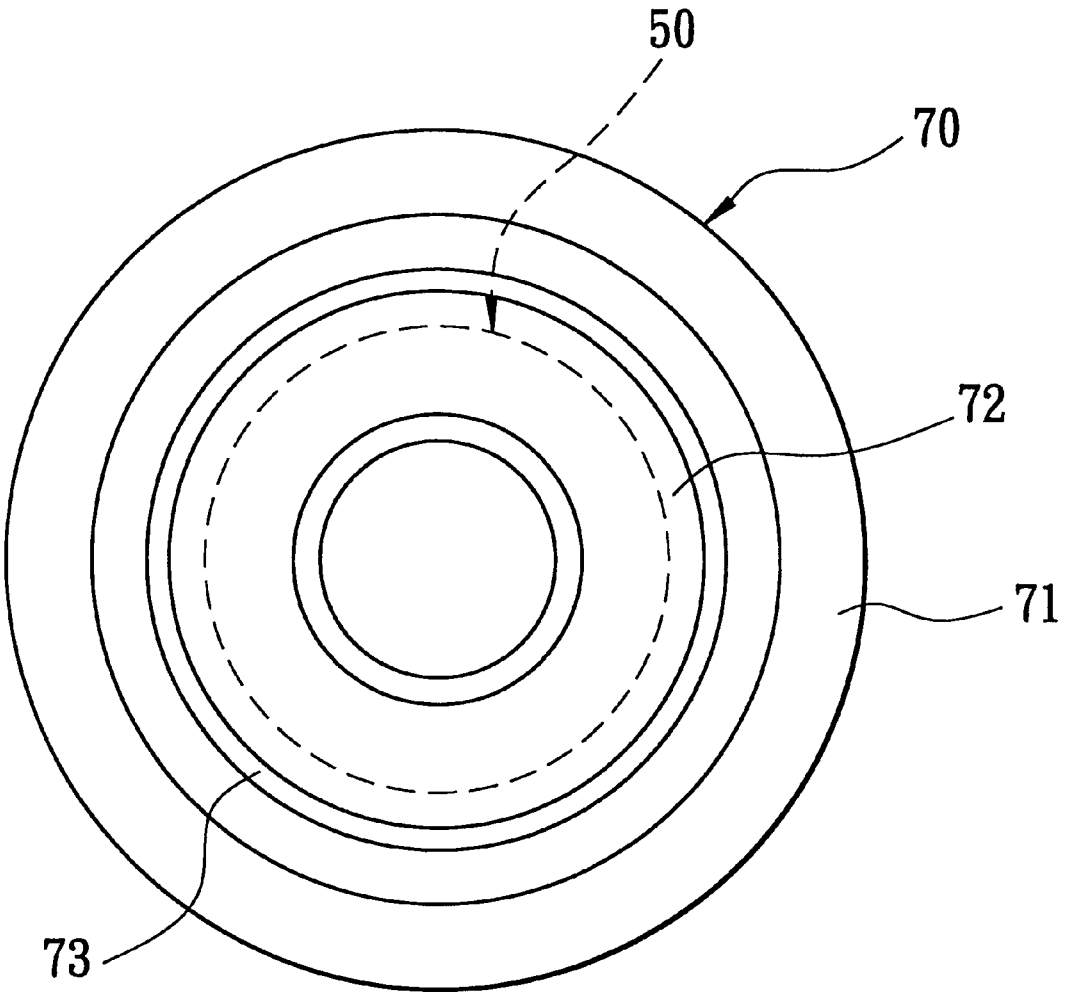
FIG. 12 is a schematic top view of the liquid dispenser of FIG. 10.

FIGS. 10 to 12 illustrate a liquid dispenser 40 embodying this invention. The liquid dispenser 40 is adapted to be connected to a fluid container (not shown), and includes a hollow shank 41, a hollow piston rod 50, a hollow piston 60, a spring seat 70, an upper spring 80, a lower spring 90, and a push-button 100.

The hollow shank 41 has opposite top and bottom openings 411, 42 and an inner space 412 extending from the bottom opening 42 to the top opening 411. A stainless steel ball 43 is seated at the bottom opening 42 and functions as a valve to control fluid flow from the fluid container (not shown) to the shank 40. A closure member 44 is mounted sealingly on the top opening 411. A ventilation hole 45 is formed in the shank 41 adjacent to the top opening 411 for communication of the shank 41 with the fluid container.

The hollow piston rod 50 extends through the closure member 44 and the top opening 411 into the inner space 412. The piston rod 50 has opposing open and closed ends 55, 56, an inner fluid passage 51 extending therein from the closed end 56 to the open end 55, a fluid exit aperture 52 disposed above the closed end 56 and in communication with the passage 51, a radial flange 53 above the aperture 52, and a tapered portion 54 tapered upward from the radial flange 53 to sealingly abut against the closure member 44.

The piston 60 includes a contact part 61 sleeved around the piston rod 50 adjacent to the closed end 56, an inner contact surface 64 in contact with the piston rod 50 to seal releasably the aperture 52, a skirt part 62 extending downward from the contact part 61, and a shoulder 63 formed between the contact part 61 and the skirt part 62 and extending inward of the inner contact surface 64 from the skirt part 63.

The spring seat 70 includes a top rim 73 confining a top blind hole 72 which receives the closed end 56, a seat flange 71 extending downward from the top rim 73, and a bottom portion 74 extending downward from the seat flange 71. The top rim 73 extends between the skirt part 62 and the closed end 56 to abut against the shoulder 63 and seal releasably the aperture 52. The top blind hole 72 is circular in shape, and has a cross-section greater than that of the closed end 56 so as to provide a clearance between the closed end 56 and the top rim 73. The clearance forms a ventilation in the blind hole 72, and facilitates smooth insertion of the closed end 56 into the top blind hole 72, thereby assuring correct positioning of the closed end 56 of the piston rod 50 in the top blind hole 72.

The upper spring 80 is sleeved around the piston rod 50 with its top end seated on the radial flange 53 and its bottom end urging against the piston 60.

The lower spring 90 has opposing upper and lower ends that urge the spring seat 70 and the ball 43 against the closed end 56 and the bottom opening 42, respectively. The bottom portion 74 of the spring seat 70 extends through the lower spring 90 with the seat flange 71 seating on the top of the lower spring 90.

The push-button 100 is mounted on the open end 55 of the piston rod 50, and has a spraying spout 110 in communication with the fluid passage 51.

A fluid chamber 413 is formed in the inner space 412, and is confined between the piston 60 and the ball 43.

Figure 13:
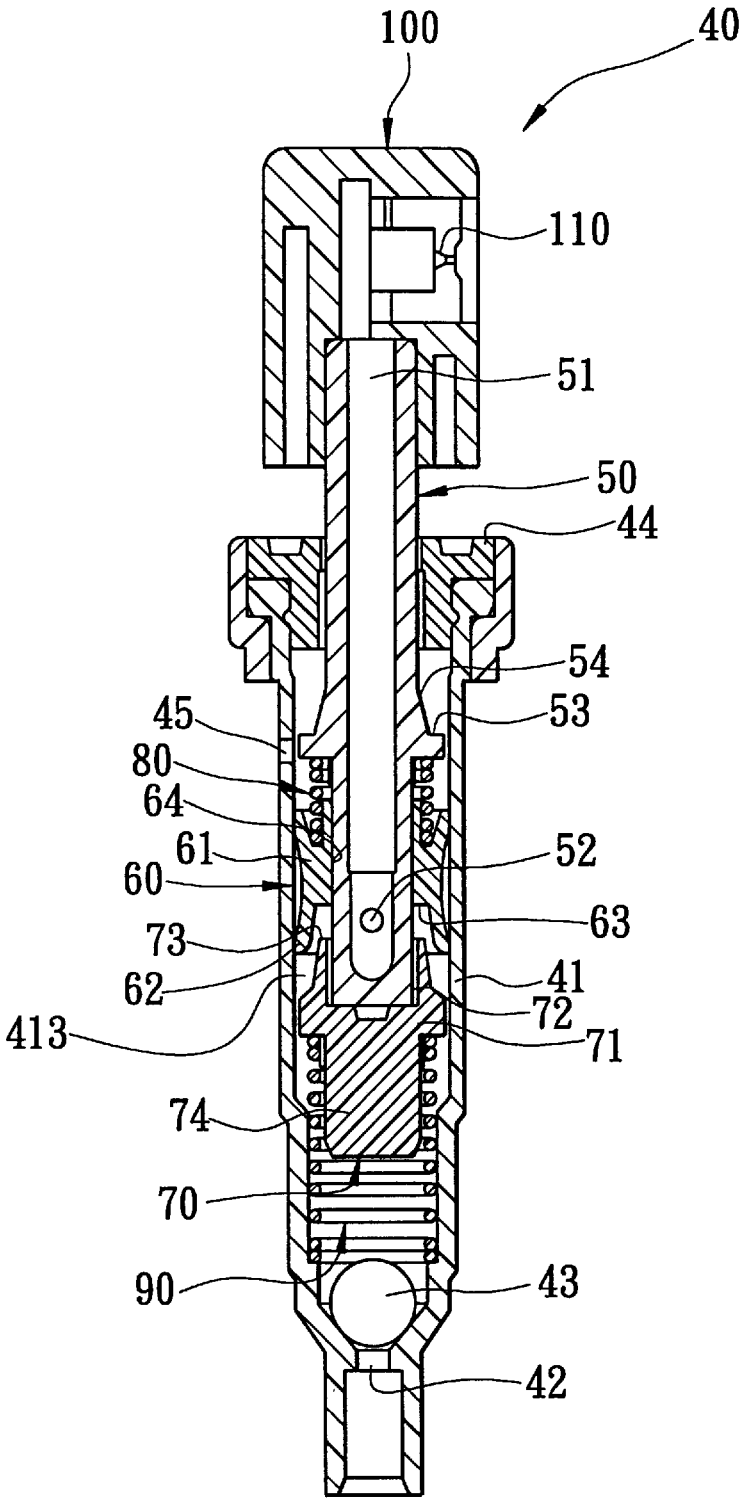
FIG. 13 is a schematic cross-sectional side view of the liquid dispenser of FIG. 10 in an operated state.

Referring now to FIG. 13, when in operation, the piston rod 50 is moved downward via the pressing of the push-button 100 to push downward the spring seat 70 which in turn pushes the lower spring 90 downward to urge the ball 43 against the bottom opening 42, thereby closing the bottom opening 42. At the same time, the fluid inside fluid chamber 413 is also pushed upward to urge against the skirt part 62, thereby moving the piston 60 upward away from the spring seat 70 and placing the aperture 52 in communication with the fluid chamber 413. This fluid then flows into the fluid passage 51 of the piston rod 50 for dispensing. As the piston rod 50 is released from pressing and returns back to its original position, the lower spring 90 releases the ball 43 and urges the spring seat 70 to move upward toward the piston 60. The upward movement of the piston rod 50 and the spring seat 70 also results in a suction force to withdraw the fluid from the container (,not shown) into the fluid chamber 413. As the piston rod 50 returns back to its original position, the tapered portion 54 abuts sealingly against the closure member 44 so as to prevent evaporation of the fluid.

In addition, as the tapered portion 54 moves away from the closure member 44, ambient air will enter into the inner space 412, and flows into the container (not shown) via the ventilation hole 45 so that the pressure in the container is the same as that of the environment.

Figure 14:
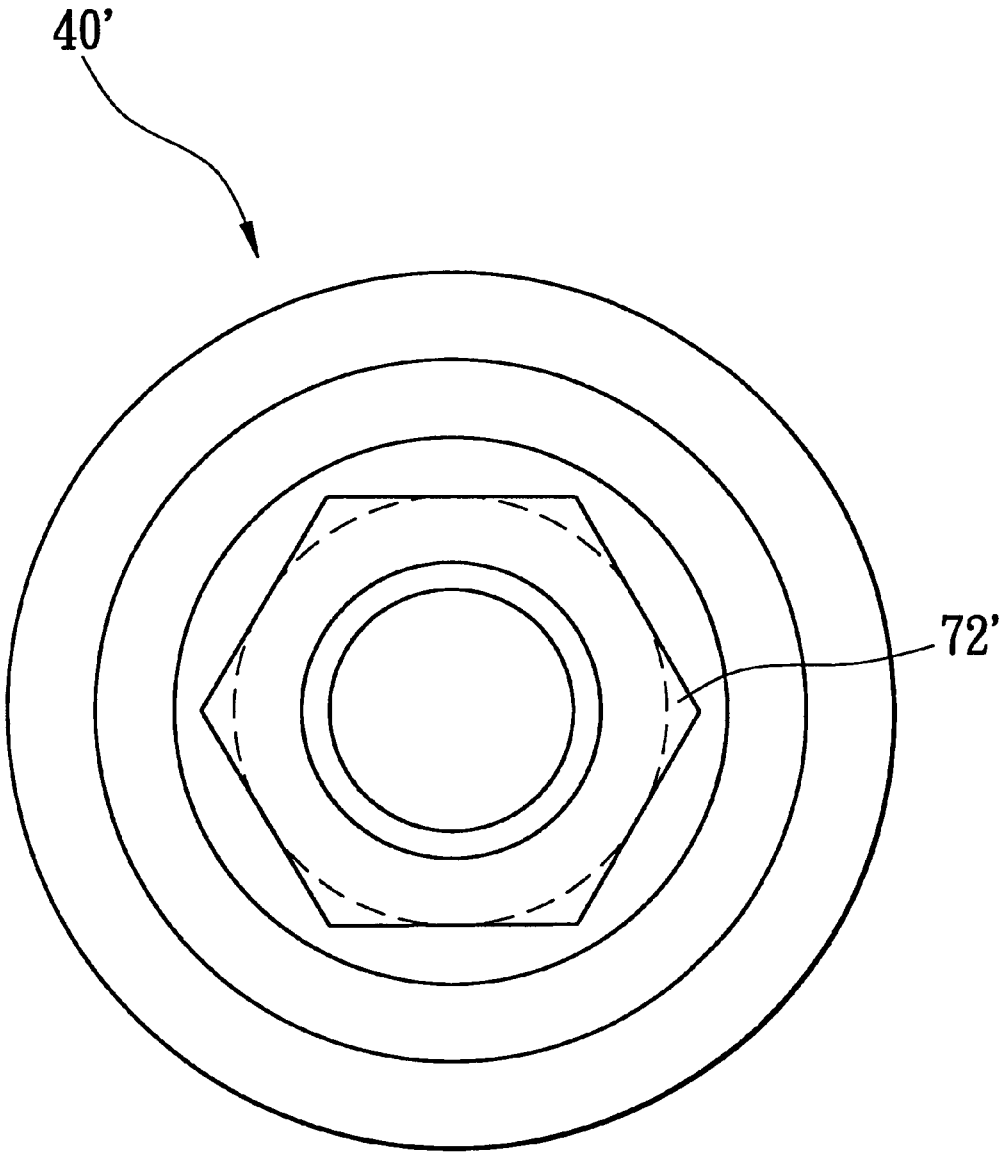
FIG. 14 is a schematic top view of a liquid dispenser of another embodiment of this invention.
Figure 15:
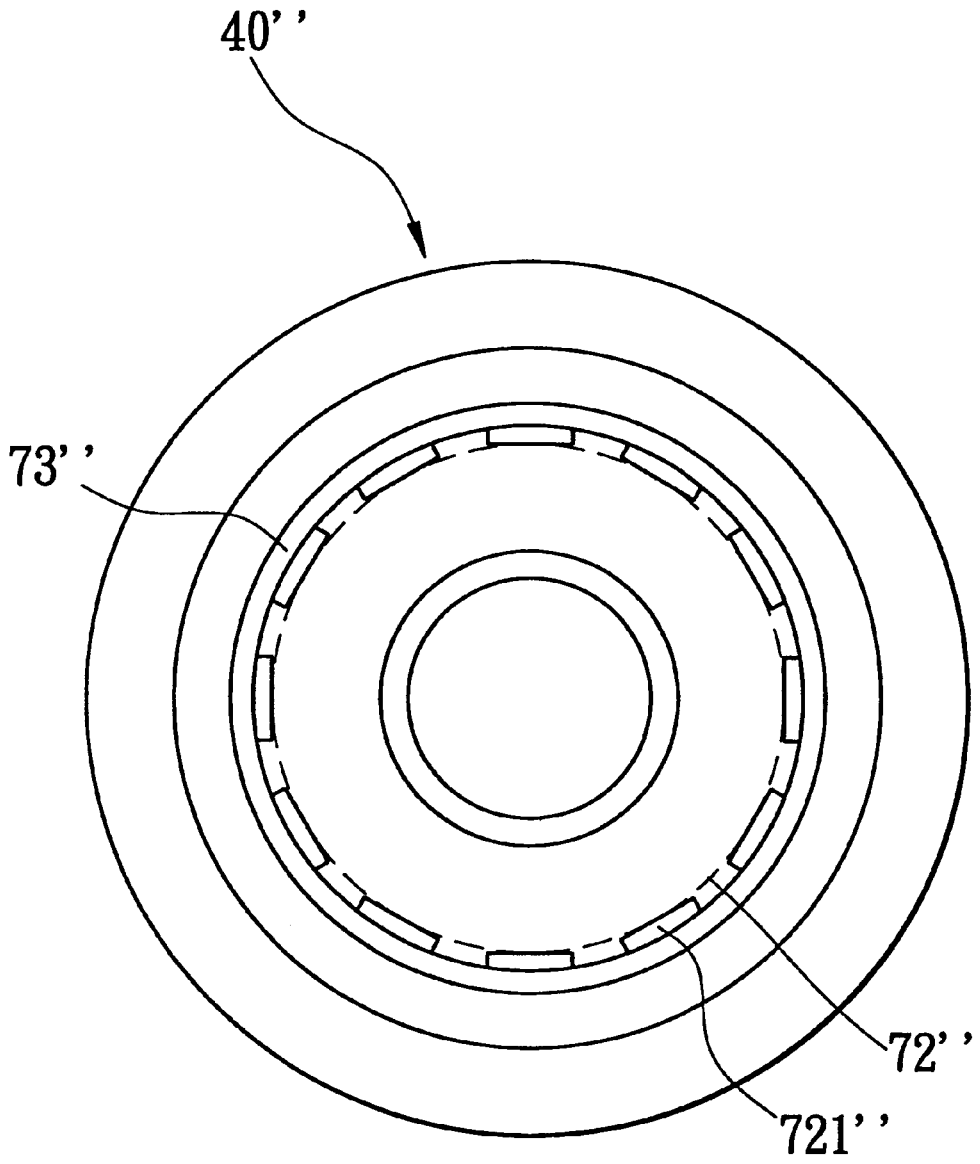
FIG. 15 is a schematic top view of a liquid dispenser of a further embodiment of this invention.

FIG. 14 illustrates a liquid dispenser 40' of another embodiment of this invention. The liquid dispenser 40' is similar to the above described liquid dispenser 40, except that the top blind hole 72' has a polygonal cross-section. FIG. 15 illustrates a liquid dispenser 40" of a further another embodiment of this invention. The liquid dispenser 40" is also similar to the above described liquid dispenser 40, except that the top rim 73 " has a plurality of spaced apart ribs 721" projecting radially into the top blind hole 72". Both arrangements provide a clearance between the closed end 56 of the piston rod 50 and the top rim 73 for the ventilation when the piston rod 50 is inserted into the blind holes 72', 72".

With the invention thus explained, it is apparent that various modifications and variations can be made without departing from the spirit of the present invention. It is therefore intended that the invention be limited only as recited in the appended claims.

I claim:

1. A liquid dispenser adapted to be connected to a container for dispensing a liquid from the container, comprising:

a hollow shank having top and bottom openings and a fluid chamber extending inside said hollow shank from said top opening to said bottom opening;

a closure member sealingly mounted on said top opening;

a hollow piston rod having closed and open ends, an inner fluid passage extending inside said piston rod from said closed end to said open end, and a fluid exit aperture disposed above said closed end and in communication with said fluid passage, said closed end being received inside said shank, said open end extending out of said shank and said closure member, said piston rod being movable upward and downward inside said shank;

a hollow piston sleeved movably around said piston rod adjacent to said closed end and having a contact part in contact with said piston rod to seal releasably said aperture, and a skirt part extending downward from said contact part;

a spring seat disposed inside said shank below said piston and having a top rim, a top blind hole confined by said top rim, and a downwardly extending bottom portion below said top blind hole, said top blind hole having a cross-section greater than that of said closed end so as to provide a clearance between said closed end and said top rim, said top rim extending between said skirt part and said closed end of said piston rod to abut sealingly against said contact part when said piston rod is moved upward;

upper urging means disposed inside said shank and sleeved around said piston rod above said piston for urging downward said piston to enable said contact part to seal said aperture;

a ball movably seated at said bottom opening for closing said bottom opening; and lower urging means disposed inside said shank and having an upper end mounted on said bottom portion and a lower end engaging said ball, said upper and lower ends urging said spring seat and said ball against said closed end and said bottom opening, respectively;

wherein said contact part moves away from said aperture and said top rim to place said aperture in communication with said fluid chamber and said fluid passage when said piston rod is moved downward.

2. The liquid dispenser of claim 1, wherein said top blind hole has a polygonal cross-section, and said closed end of said piston rod has a circular cross-section.

3. The liquid dispenser of claim 1, wherein said top rim has a circular cross-section, and includes a plurality of spaced apart ribs projecting radially into said top blind hole.

4. The liquid dispenser of claim 1, wherein said piston rod has a radially extending flange formed above said upper urging means to seat said upper urging means and a tapered portion that is tapered upward from said flange to sealingly abut against said closure member when said piston rod is moved upward.

5. The liquid dispenser of claim 1, further comprising a push-button connected to said top opening and having a spraying spout in communication with said fluid passage.

* * * * *